US007302346B2

(12) United States Patent
Chang et al.

(10) Patent No.: US 7,302,346 B2
(45) Date of Patent: Nov. 27, 2007

(54) DATA LOGGING

(75) Inventors: Chung Chang, Wilton, CT (US); Marwan Moufarrej, Houston, TX (US); Sandip Bose, Brookline, MA (US); Tarek Habashy, Danbury, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 22 days.

(21) Appl. No.: 11/311,609

(22) Filed: Dec. 19, 2005

(65) Prior Publication Data

US 2007/0143022 A1 Jun. 21, 2007

(51) Int. Cl.
*G01V 3/18* (2006.01)

(52) U.S. Cl. ..... 702/9

(58) Field of Classification Search ..... 702/6, 702/7, 9

See application file for complete search history.

(56) References Cited

U.S. PATENT DOCUMENTS

| | | | | |
|---|---|---|---|---|
| 5,787,997 | A * | 8/1998 | Hartmann | 175/45 |
| 5,896,939 | A | 4/1999 | Witte | 175/40 |
| 6,405,136 | B1 * | 6/2002 | Li et al. | 702/10 |
| 6,564,883 | B2 * | 5/2003 | Fredericks et al. | 175/50 |
| 6,581,699 | B1 * | 6/2003 | Chen et al. | 175/61 |
| 6,600,321 | B2 * | 7/2003 | Evans | 324/369 |
| 6,877,241 | B2 * | 4/2005 | Barr et al. | 33/544 |
| 6,957,580 | B2 * | 10/2005 | Ekseth et al. | 73/488 |
| 6,957,708 | B2 * | 10/2005 | Chemali et al. | 175/50 |
| 7,055,601 | B2 * | 6/2006 | Barrow | 166/255.1 |
| 2005/0060096 | A1 * | 3/2005 | Hutchinson | 702/6 |
| 2005/0169717 | A1 | 8/2005 | Field | 408/13 |

FOREIGN PATENT DOCUMENTS

| | | |
|---|---|---|
| EP | 0 449 710 A2 | 10/1991 |
| GB | 2 327 501 A | 1/1999 |
| GB | 2 396 697 A | 6/2004 |

OTHER PUBLICATIONS

Combined Search and Examination Report under Sections 17 and 18(3) issued by the United Kingdom Patent Office for Application No. GB0624699.5.

* cited by examiner

*Primary Examiner*—Donald E McElheny, Jr.
(74) *Attorney, Agent, or Firm*—Vincent P. Loccisano; Jody Lynn DeStefanis; Steven McHugh

(57) ABSTRACT

A device and method for determining a geophysical characteristic of a borehole using at least one logging device is provided, wherein the at least one logging device includes at least one sensing device. The method includes associating the at least one sensing device with the borehole, wherein the at least one sensing device includes a sensing device measurement length. The method also includes operating the at least one sensing device to generate borehole data responsive to a borehole portion disposed essentially adjacent the sensing device measurement length, wherein the borehole data includes start time of scan, location of the at least one sensing device at start time of scan, stop time of scan and location of the at least one sensing device at stop time of scan. Furthermore, the method includes correlating the borehole data to determine the geophysical characteristic.

22 Claims, 24 Drawing Sheets

DATA LOGGING

FIELD OF THE INVENTION

This disclosure relates generally to measuring characteristics of a well bore and more particularly to the measuring and logging accurate depth information in a drilling environment.

BACKGROUND OF THE INVENTION

Fluids, such as oil, gas and water, are commonly sought out and recovered from subterranean formations below the earth's surface using a variety of drilling rigs. These drilling rigs typically drill long, slender well bores into the earth formation to establish a fluid communication between the fluid deposits and the surface through the drilled well bore. During the drilling process logging tools are used to measure the properties of the earth formation along the well bore, such as well bore depth, bulk density, resistivity and porosity. These logging tools are well known and use various techniques to determine the geophysical properties of the earth formation. From these properties, the surrounding formation can be characterized and the information used to determine the likelihood of the presence of hydrocarbons in the formation and/or the ease of producing these hydrocarbons.

For several reasons, information pertaining to the location of the drill bit, such as drill bit depth and Rate of Penetration (ROP) is of particular interest to the study of the geophysical properties of the surrounding earth formation. First, knowledge of drill bit depth is helpful in determining the composition of the strata in which the drill is currently boring. This information can be used by a drill rig operator to determine the weight, speed, and torque to which a drill bit should be adjusted to obtain the optimum drilling performance. The second reason involves the use of the drilling fluid used to maintain control and stability of the borehole by cooling and lubricating the drill head, conveying the drill tailings to the surface and by keeping the hydrostatic pressures in balance. Because the composition of the drilling fluid is typically selected based on strata properties, such as the rock conditions, the borehole size and the borehole length, information about the strata is important in selecting a suitable drilling fluid composition. The third reason involves the Rate of Penetration (ROP) or the rate at which a drill bit penetrates the strata, wherein the ROP provides information about the formation being drilled and the state of the drill bit being used. This information is essential in optimizing the drilling operation. Finally, in directional drilling an accurate estimate of the location is indispensable for adhering to well trajectory and reaching targeted reservoirs in optimal fashion.

Currently, the two most common logging methods being used to determine the depth and other geophysical properties of a borehole are the WireLine method and the Logging While Drilling (LWD) method. The wireline well-logging method employs a well-logging tool, such as a sonde, that is lowered into the well-bore on an electrical cable or wireline. The well-logging tool is an electrically powered measurement device that includes several sensors that measure and collect data regarding the parameters of a borehole and/or its environment. Once measurements have been collected, the measurement data are usually converted into a digital format and transmitted to the surface on the wireline cable. Unfortunately however, although wireline tools are capable of obtaining accurate data, the wireline method is somewhat cumbersome and repetitive in that the wireline cable must be towed along the borehole and that the well must first be drilled before the wireline measurements are conducted and the logs are generated. This is undesirable for several reasons. The first reason involves the time added by having to traverse the borehole multiple times, first to drill the borehole and then to measure the borehole. The second reason is that because the borehole is measured after the borehole has been drilled, the analysis and data collection cannot be conducted on a concurrent basis. Thus, presently information is not available to allow a drill team to direct a drill string in relation to depth, attitude, or inclination using concurrent data analysis.

On the other hand, the LWD method provides for a real-time quantitative analysis of the sub-surface formations during the actual drilling operation and can be run to allow the drill team to better direct the drill string during drilling. The LWD logging method typically includes drilling a borehole into the earth and recording information regarding the geophysical properties of the borehole from sensors, which are typically disposed above the drill bit. The log of these measurements produces a record of various geophysical properties relative to the borehole depth. Unfortunately however, although the LWD method is capable of obtaining data on a real-time basis, the LWD method includes inherent inaccuracies. Further, the current LWD tools do not allow for borehole depth measurements that are independent of a surface tracking system. Because the drill bit does not necessarily move in synchronization with the tail end or surface end of the piping, movement of the drill bit may not be immediately noticed at the surface. As a result, depth measurements made close to the drill bit may be inaccurate. Further, during the drilling process, the drill string typically experiences vibrations and/or rotations which may cause warping in the drill pipe, adding further to the inaccuracies of the LWD measurements.

An additional way to obtain an accurate measurement of the borehole depth is to measure the drill string pipes before sending them down-hole. Because, this measurement is based on what is observed at the surface, the measurements may not accurately translate to the subterranean level due to stretching of the drill string or due to stick or slip. As such, it would be imprudent to have a drilling team rely on measurements taken from observations that cannot be confirmed. Further, because what is observed at the surface may not accurately translate to the subterranean level, it is possible that synchronization problems can occur.

SUMMARY OF THE INVENTION

A method for determining the length of a borehole is provided, wherein the method includes associating at least one sensing device with the borehole, wherein the at least one sensing device includes a sensing device measurement length. The method further includes operating the at least one sensing device to generate borehole data responsive to a borehole portion disposed essentially adjacent the at least one sensing device measurement length, wherein the borehole data includes start time of scan, start location position of the at least one sensing device at start time of scan, stop time of scan and location of the at least one sensing device at stop time of scan. Moreover, the method includes correlating at least a portion of the borehole data to determine the length of at least a portion of the borehole.

A method for determining a geophysical characteristic of a borehole using at least one logging device is provided, wherein the at least one logging device includes at least one sensing device. The method includes associating the at least one sensing device with the borehole, wherein the at least one sensing device includes a sensing device measurement length. The method also includes operating the at least one sensing device to generate borehole data responsive to a borehole portion disposed essentially adjacent the sensing device measurement length, wherein the borehole data includes start time of scan, location of the at least one sensing device at start time of scan, stop time of scan and location of the at least one sensing device at stop time of scan. Furthermore, the method includes correlating the borehole data to determine the geophysical characteristic.

A logging device for use with a drill rig having a drill string that is associated with a borehole is provided, wherein the logging device includes a device housing, configured to be associated with the drill string and wherein the device housing includes a housing length. At least one sensing device is provided, wherein the at least one sensing device is associated with the device housing to generate sensor data responsive to a characteristic of at least a portion of the borehole, wherein the portion of the borehole corresponds to at least a portion of the housing length.

BRIEF DESCRIPTION OF THE DRAWINGS

The foregoing and other features and advantages of the present invention should be more fully understood from the following detailed description of illustrative embodiments taken in conjunction with the accompanying Figures in which like elements are numbered alike in the several figures.

DETAILED DESCRIPTION

As discussed herein, by scanning the borehole at predetermined locations and logging the start time of the scan, the location of the sensing device at start time of the scan, the stop time of the scan and the location of the sensing device at the stop time of the scan geophysical characteristics of the borehole may be accurately determined, such as an accurate logging depth of the borehole. All data generate may be correlated to each other to generate continuous and/or non-continuous spatially accurate data on both a local level (i.e. within a predefined region or portion of the borehole) and a global level (i.e. along the entire length of the borehole). This data may be generated using a sensing device, such as gamma-ray sensors, temperature sensors, pressure sensors, gas content sensors, magnetic compasses, strain gauge inclinometers, magnetometers and gyro compasses that is capable of generating desired information regarding a borehole characteristic, such as borehole depth, Rate of Penetration (ROP), porosity, bulk density and resistivity. Additionally, the data may be stored or "logged" for further processing once all or a portion of the borehole data has been obtained.

For example, data logging may be initiated by selecting a location in the borehole where the logging device begins generating borehole data. This location is the initial starting point and may be used to define at least one parameter of the global reference frame to which all other borehole data generated by the logging device may be synchronized. The starting point and ending point for the data generated by each scan performed by the logging device is identified and may be used to define local reference frames, wherein the data for the initial starting point is identified as $Log_1$ and wherein the starting point and ending point for each successive scan is identified as $Log_n$. Each of these local reference frames may then be correlated to the initial starting point to define the global reference frame and to connect each scan in order to create continuous and/or semi-continuous data for the borehole. Moreover, although the method disclosed herein is discussed in terms of a reference frame being a point in time, any reference frame suitable to the desired end purpose may be used.

Figure 1:
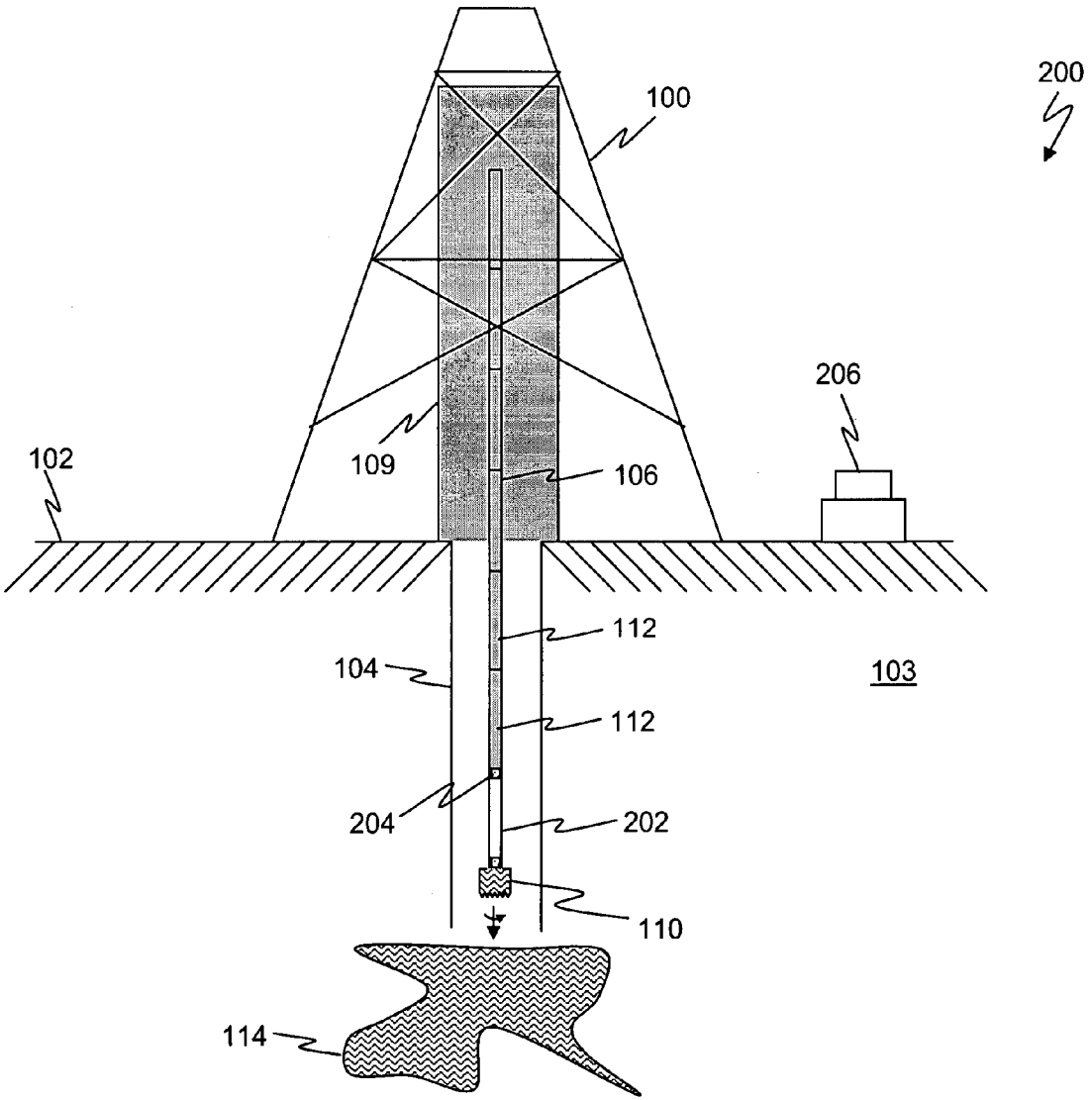
FIG. 1 is an elevation view of a logging device associated with a drill rig drilling a borehole.
Figure 4:
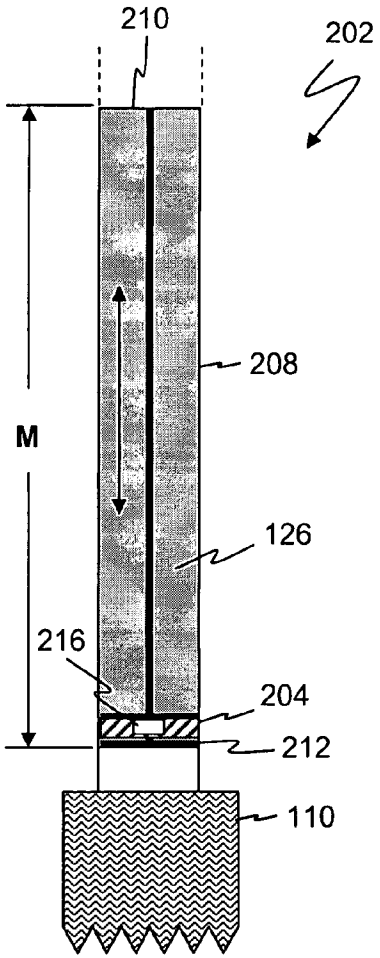
FIG. 4 is a cross sectional side view of the logging device of FIG. 3.
Figure 3:
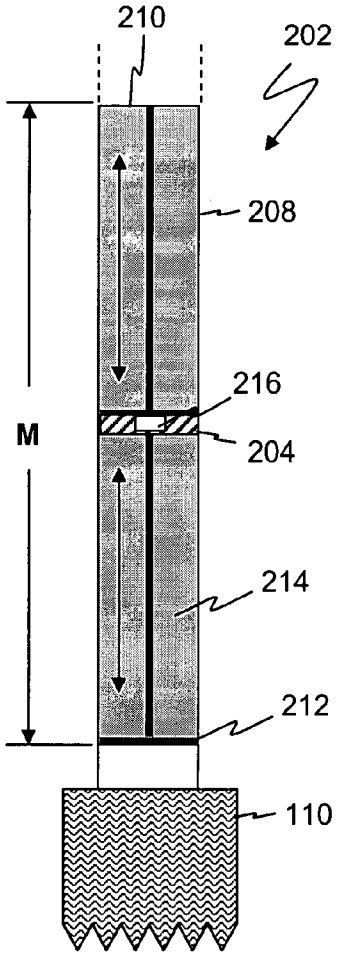
FIG. 3 is a cross sectional side view of the logging device of FIG. 3.
Figure 2:
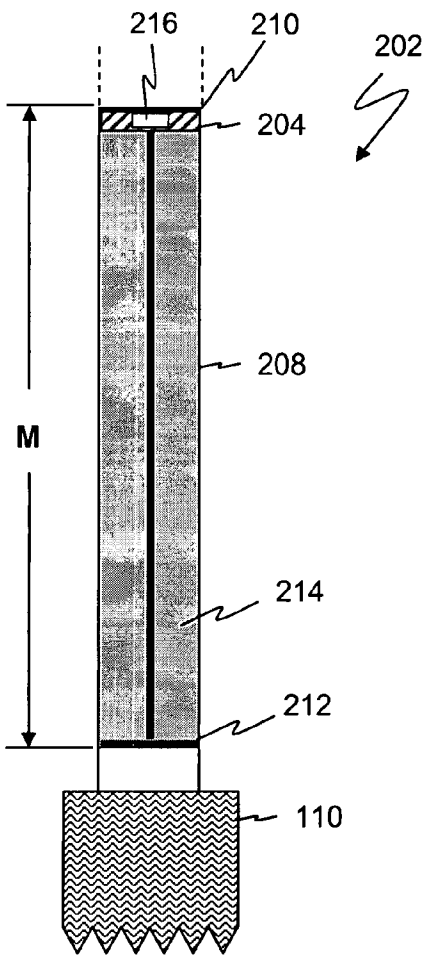
FIG. 2 is a cross sectional side view of a logging device in accordance with a first embodiment.

Referring to FIG. 1, a typical drilling rig 100 is shown, wherein the drilling rig 100 is disposed on the earth surface 102. A borehole 104 is drilled beneath the rig 100, wherein the borehole 104 extends down below the earth surface 102 into the earth formation 103. The drilling rig 100 includes a drilling subassembly 106 comprising a drill bit portion 110 connected to a drilling bit actuation device 109 via a plurality of drill pipes 112. During the drilling process, once the borehole 104 reaches a depth approximately equal to the length of the drilling subassembly 106, additional drill pipes 112 are added to the drilling subassembly 106 and the drilling process is repeated until the borehole 104 extends to a desired depth.

Also as shown in FIG. 1, a first embodiment of a logging system 200 is shown associated with the drilling rig 100 and includes at least one logging device 202 having at least one sensing device 204 and a data processing device 206. Referring to FIG. 2, FIG. 3, FIG. 4 and FIG. 5, the logging device 202 is shown and includes a logging device structure 208, wherein the logging device structure 208 includes a first logging device structure end 210, a second logging device structure end 212 and a logging device structure length M. Additionally, the logging device structure 208 defines a logging device structure cavity 214 extending the logging device structure length M to communicate the first logging device structure end 210 with the second logging device structure end 212. The logging device 202 may also include the at least one sensing device 204 and a data storage device 216, wherein the sensing device 204 is movably disposed within the logging device structure cavity 214 such that the sensing device 204 is able to controllably traverse a predetermined portion of the logging device structure cavity 214 disposed between the first logging device structure end 210 and the second logging device structure end 212, wherein as the sensing device 204 is traversing the predetermined portion of the logging device structure cavity 214 the sensing device 204 may scan the geophysical properties of the adjacent strata while logging information regarding the traversal through the logging device structure cavity 214. The data obtained during the scan may then be saved in the data storage device 216 for later processing. Additionally, the sensing device 204 may include a processing device for processing the obtained data upon completion of each scan.

Figure 6:
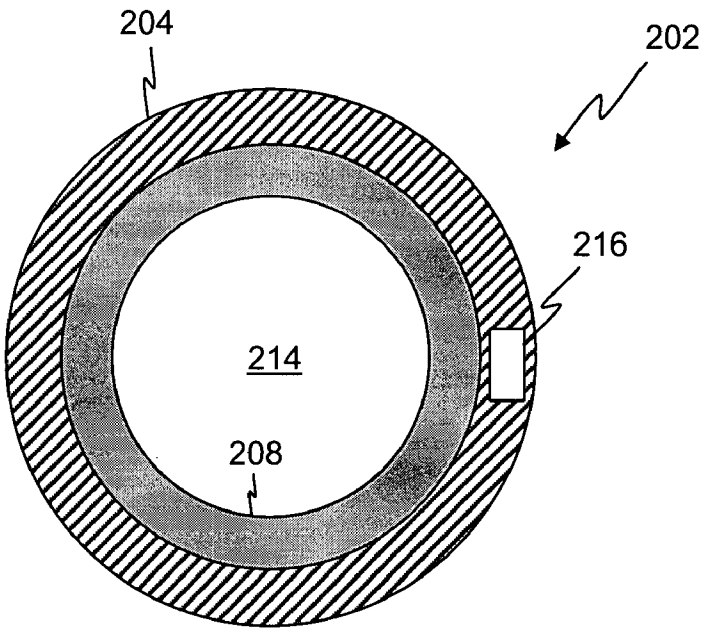
FIG. 6 is a cross sectional top down view of the logging device of FIG. 3 with an external configuration.
Figure 5:
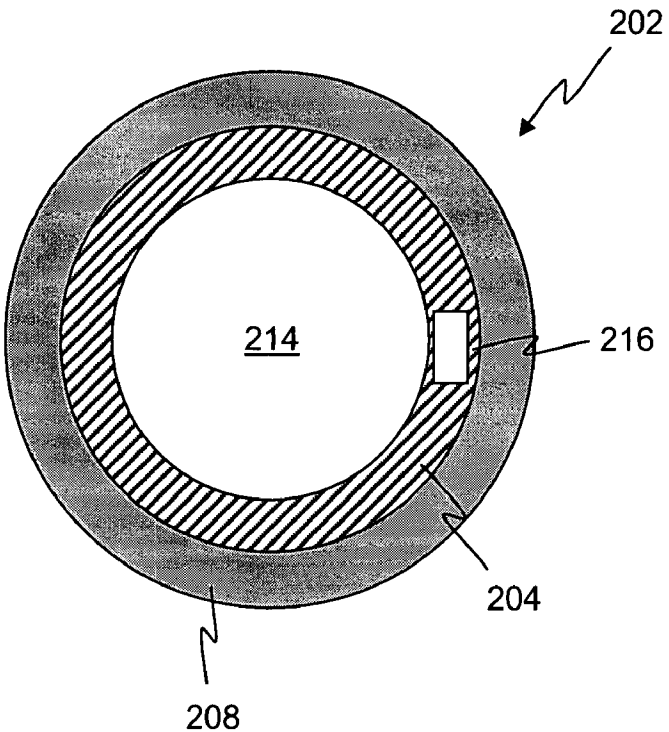
FIG. 5 is a cross sectional top down view of the logging device of FIG. 3.

It should be appreciated that at least a portion of the data measurements obtained may be based at least in part on the position of the sensing device 204 in the borehole 104 at a specific point in time. This may be accomplished via the use of a mechanical indicator or via a virtual indicator generated via software in response to spatial conditions of the logging device 202. Moreover, the sensing device 204 may also be disposed external to the logging device structure 208, as shown in FIG. 6.

Figure 7:
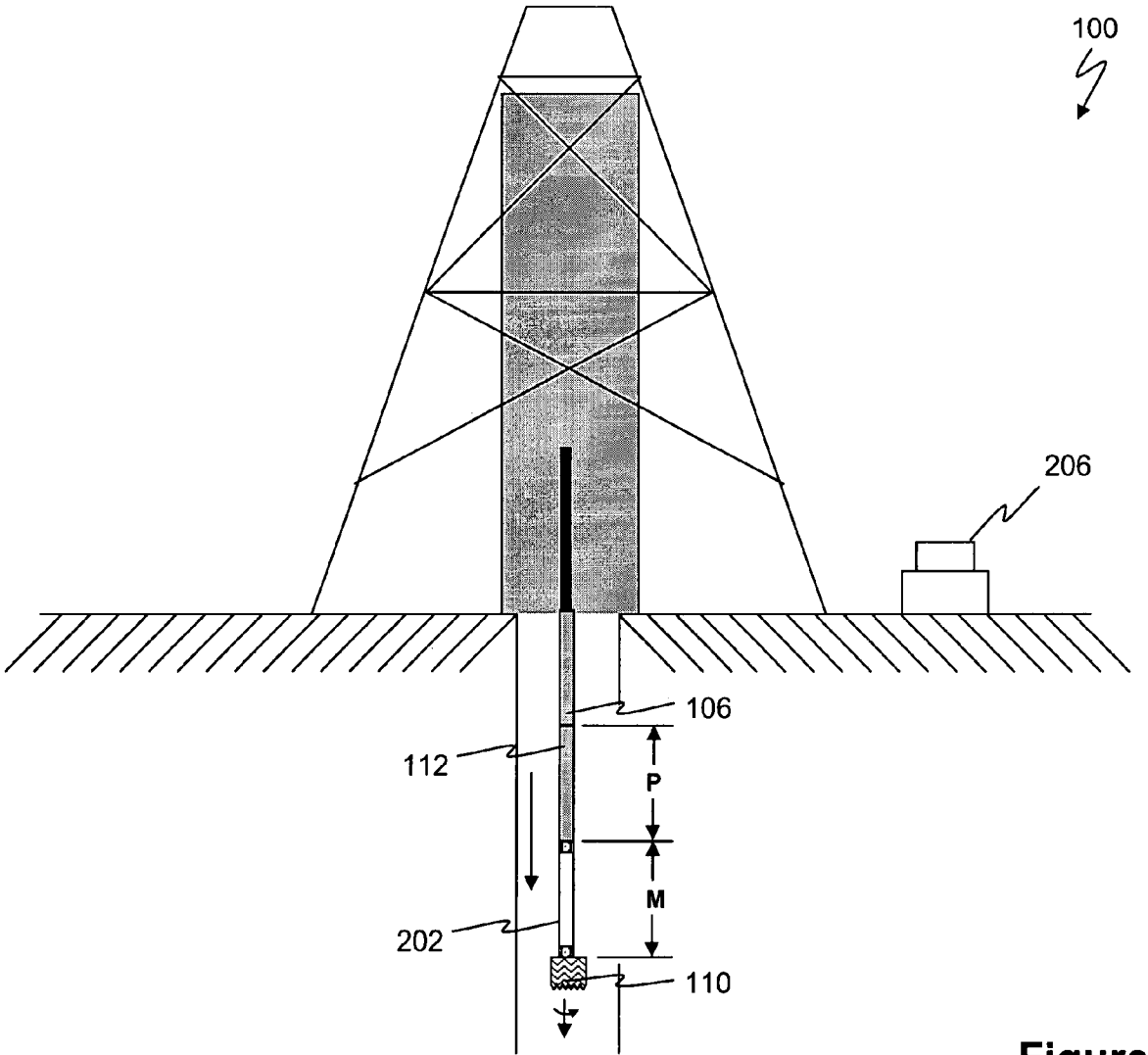
FIG. 7 is a front view of the logging device of FIG. 3 associated with a drill rig drilling a borehole.
Figure 8:
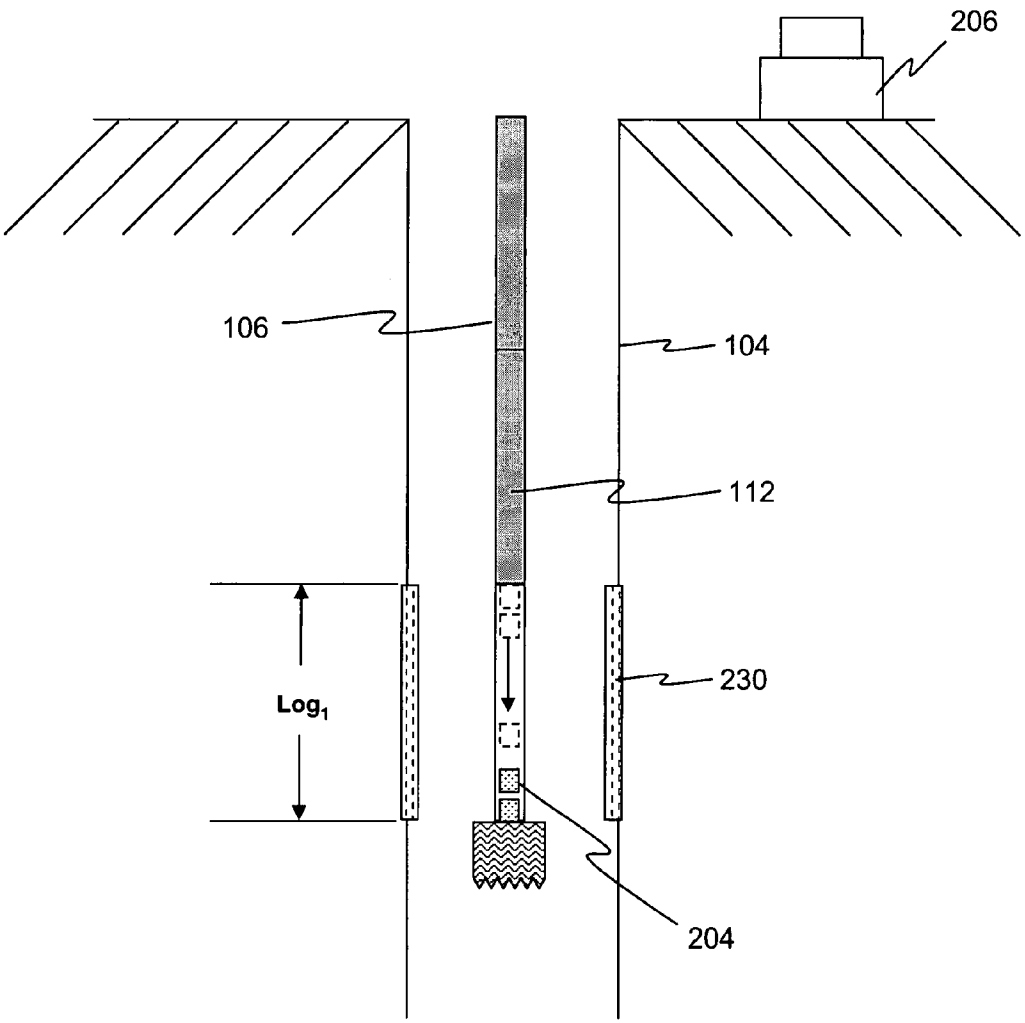
FIG. 8 is a side view of the logging device of FIG. 3 associated with a drill string disposed within a borehole.
Figure 9:
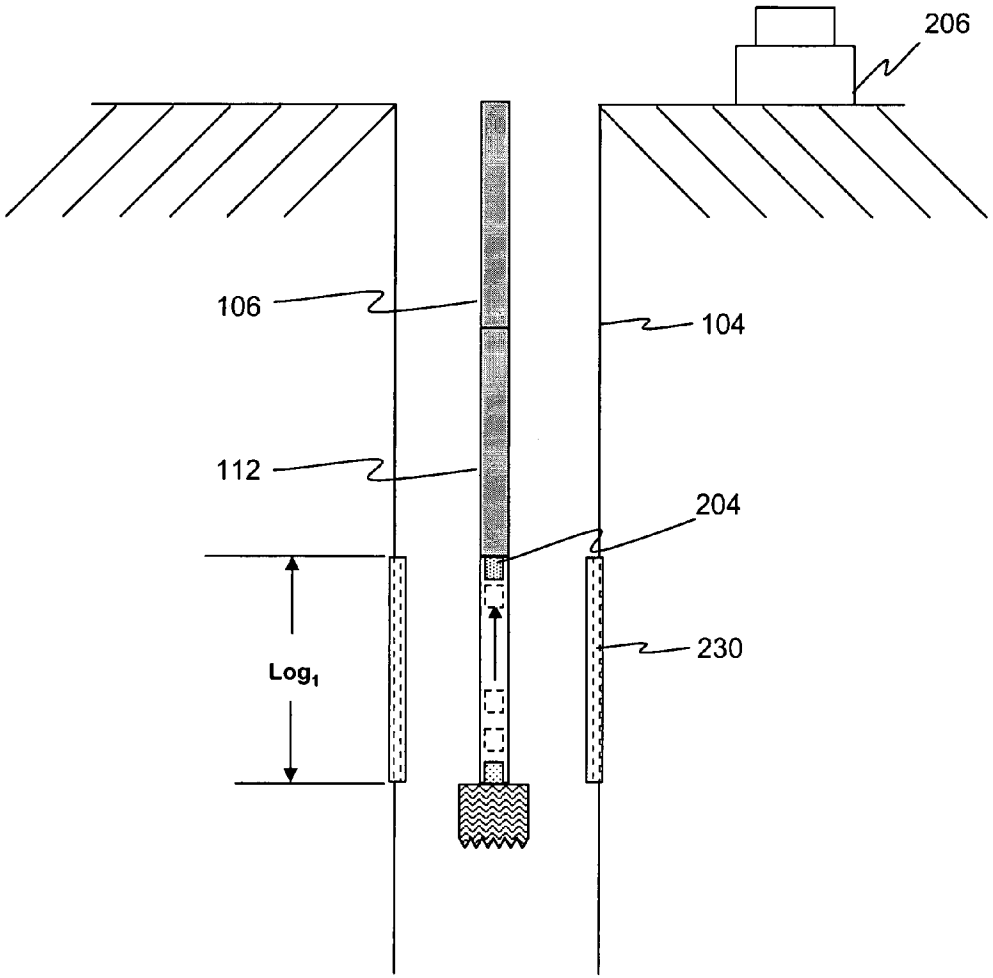
FIG. 9 is a side view of the logging device of FIG. 3 associated with a drill string disposed within a borehole.

Referring to FIG. 7, FIG. 8 and FIG. 9, the logging system 200 may be implemented as follows. Consider the situation where additions to the drilling subassembly 106 occurs three drill pipes 112 at a time and the logging device 202 is disposed adjacent to the drill bit portion 110, wherein the logging device 202 includes a logging device structure length M and the each of the drill pipes 112 includes a drill pipe length P. Furthermore, although the logging device structure length M is shown herein as being approximately equal to the drill pipe length P, the logging device structure length M and/or the drill pipe length P may be any length suitable to the desired end purpose. As shown in FIG. 7, when the drill bit portion 110 drills the length of the drilling subassembly 106 (i.e. the number of drill pipes multiplied by the drill pipe length P) such that more drill pipes 112 (in this example 3) have to be added to the drilling subassembly 106, the drilling is stopped while more drill pipes 112 are added to the drilling subassembly 106. During this time, the sensing device 204 scans a first portion 230 of the borehole 104 for physical characteristics of the first portion 230, such as the length of the first portion 230, and logs this information, wherein the first portion 230 is that portion of the borehole 104 that is adjacent to the logging device 202 at the time of the scan, as shown in FIG. 8. This may be accomplished by operating the logging device 202 to cause the sensing device 204 to traverse the length M of the logging device structure 208 and scan the borehole 104 during the traversal. When the sensing device 204 has traversed the length M of the logging device structure 208 and has thus completed its scan, the sensing device 204 may identify the borehole data as $Log_1$ and store the sensor data $Log_1$ within the data storage device 216. The sensing device 204 may then return to its original position within the logging device structure cavity 214, as shown in FIG. 9. Moreover, while three drill pipes are shown in this example, other increments may be suitably employed.

Figure 10:
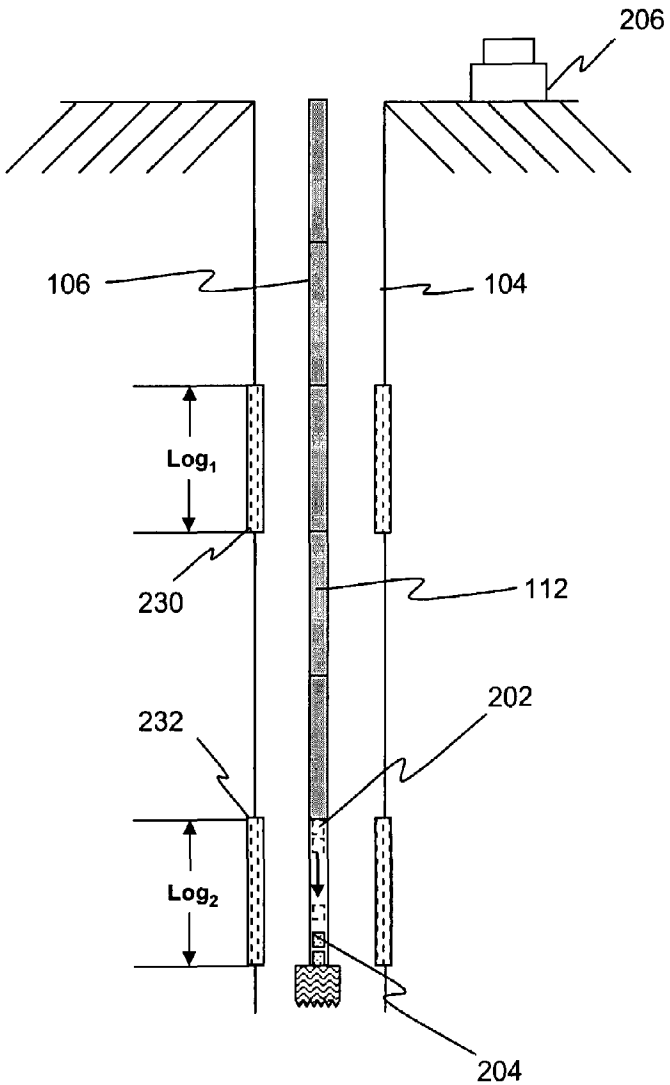
FIG. 10 is a side view of the logging device of FIG. 3 associated with a drill string disposed within a borehole.

Referring to FIG. 10, once the drill pipes 112 have been added to the drilling subassembly 106, the drilling is resumed until the drill bit portion 110 again drills down the additional length of the drilling subassembly 106 such that additional sections of drill pipes 112 may be added to the drilling subassembly 106. The drilling is then stopped while more drill pipes 112 are added to the drilling subassembly 106 and the sensing device 204 scans a second portion 232 of the borehole 104, wherein the second portion 232 of the borehole 104 is that portion of the borehole 104 that is adjacent to the logging device 202 at the time of the scan. As above, the sensing device 204 may identify the sensor data as $Log_2$ and store the sensor data $Log_2$ within the data storage device 216 and again return to its original position.

Figure 11:
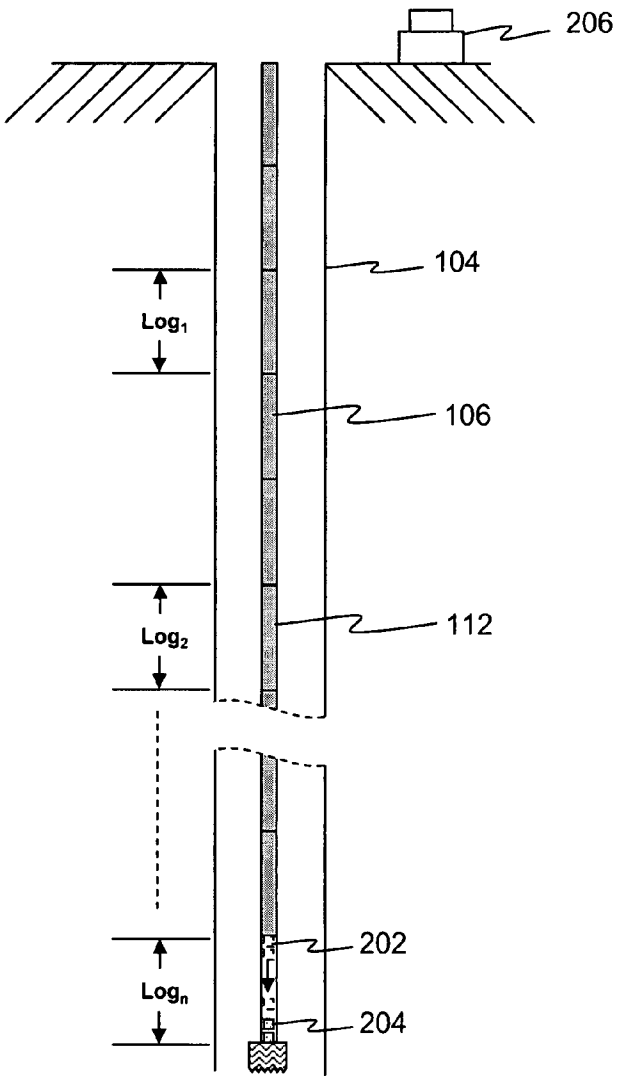
FIG. 11 is a side view of the logging device of FIG. 3 associated with a drill string disposed within a borehole.

Referring to FIG. 11, this process may include combining overlapping $Log_n$'s and may be repeated as many times and the data identified and stored as $Log_n$ as necessary to measure the depth of the borehole 104. The stored data $Log_1$ through $Log_n$ may then be combined to approximate the depth of the borehole 104 with a high degree of precision. Additionally, this process may be refined even more to achieve a greater accuracy in the depth measurement of the borehole 104. This is because periodically the drill bit portion 110 needs to be changed and as such, needs to be removed from the borehole 104. To do this, the entire drilling subassembly 106 is removed from the borehole 104. Assuming that measurements regarding the borehole 104 were conducted as discussed above, we can achieve a more accurate measurement by taking measurements as the drilling subassembly 106 is removed from the borehole 104. Furthermore, if these measurements were offset to measure areas not measured during the drilling process, then a greater borehole depth resolution may be achieved.

Figure 12:
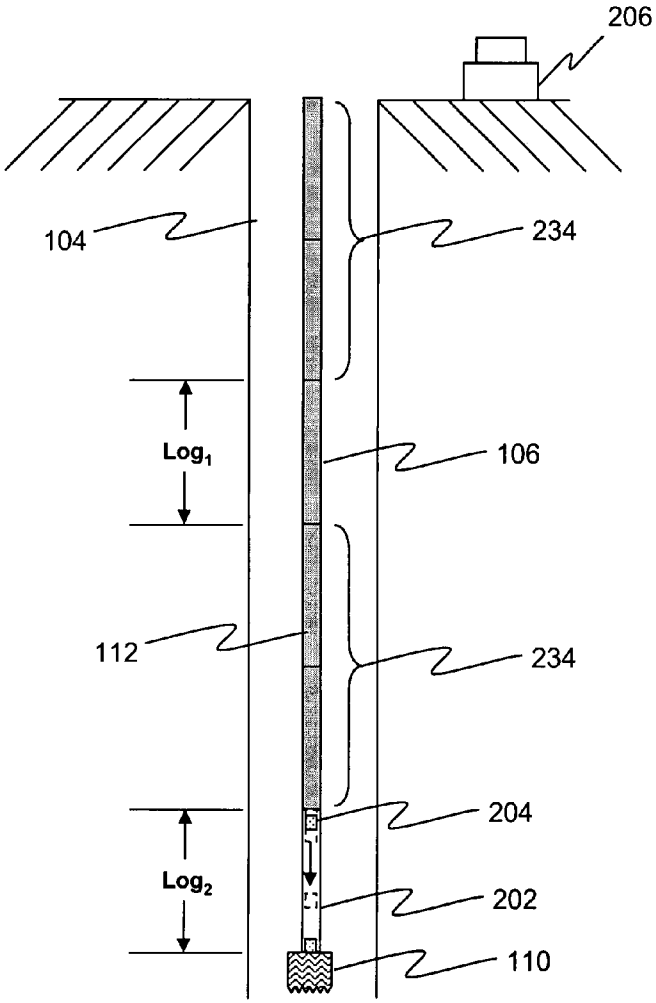
FIG. 12 is a side view of the logging device of FIG. 3 associated with a drill string disposed within a borehole.
Figure 13:
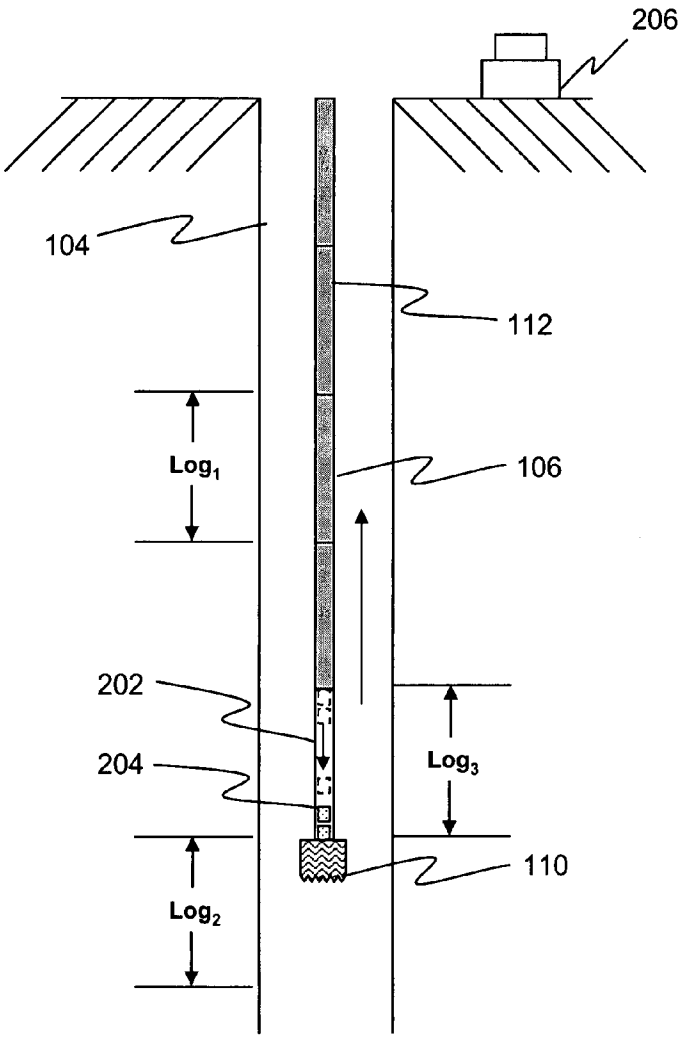
FIG. 13 is a side view of the logging device of FIG. 3 associated with a drill string disposed within a borehole.
Figure 14:
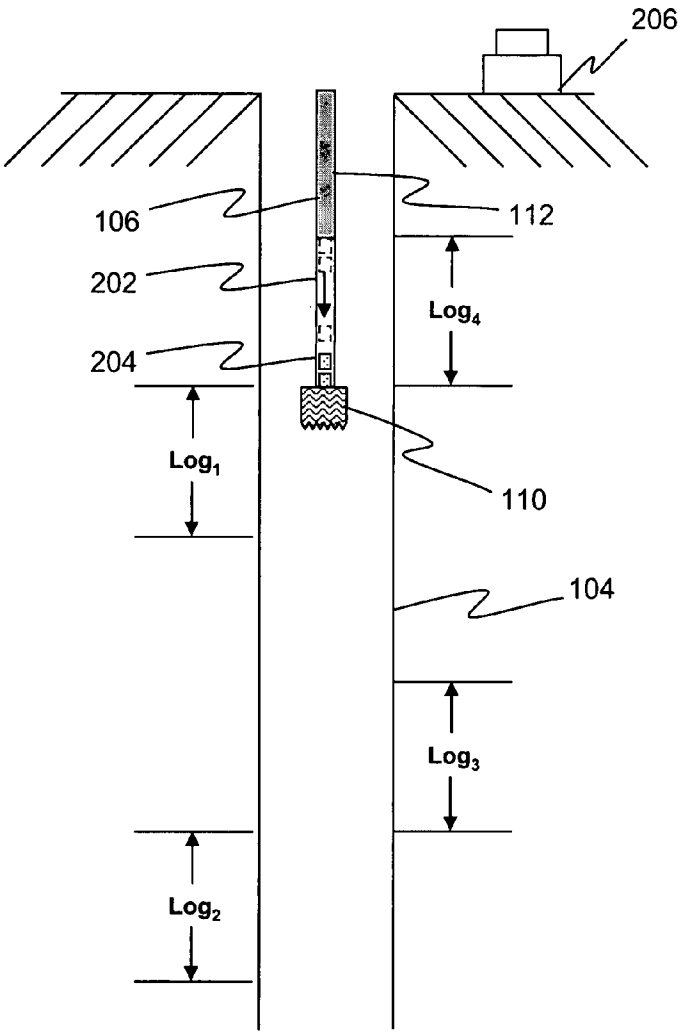
FIG. 14 is a side view of the logging device of FIG. 3 associated with a drill string disposed within a borehole.

For example, referring to FIG. 12, assume that the drill bit portion 110 needs to be changed after the addition of drill pipes 112 so that the drilling subassembly 106 comprises five drill pipes 112 and one logging device 202 disposed adjacent the drill bit portion 110. Thus, only two measurements, $Log_1$ and $Log_2$, were conducted by the sensing device 204 during the drilling of the borehole 104 and as can be seen, there are still unmeasured areas 234 of the borehole 104. Using the data obtained during the prior scans, $Log_1$ and $Log_2$, the approximate location of where the prior scans took place relative to the drill bit portion 110 may be determined and used to stop the drilling subassembly 106 and initiate a scan such that the borehole data portions may provide a continuous log. Additionally, while the present methodology allows for a continuous log, it is not necessary to obtain a continuous log in practicing this invention. Referring to FIG. 13, as the drilling subassembly 106 is raised from the borehole 104, the drill bit portion 110 of the drilling subassembly 106 is stopped just prior to where the beginning of the prior scan, $Log_2$, has occurred, leaving sufficient margin to account for errors induced, for example by stretching or sticking of the drill string and ensuring an overlap with the prior scan, $Log_2$. The drill pipes 112 above ground are removed and a measurement of the borehole 104 is conducted. The sensor data is identified as $Log_3$ and stored within the data storage device 216. The drilling subassembly 106 is then raised until the drill bit portion 110 reaches a position just below where the beginning of the first prior scan, $Log_1$, has occurred. Again, the drill pipes 112 above ground are removed and a measurement of the borehole 104 is conducted. The sensor data is identified as $Log_4$ and stored in the data storage device 216, as shown in FIG. 14.

Figure 15:
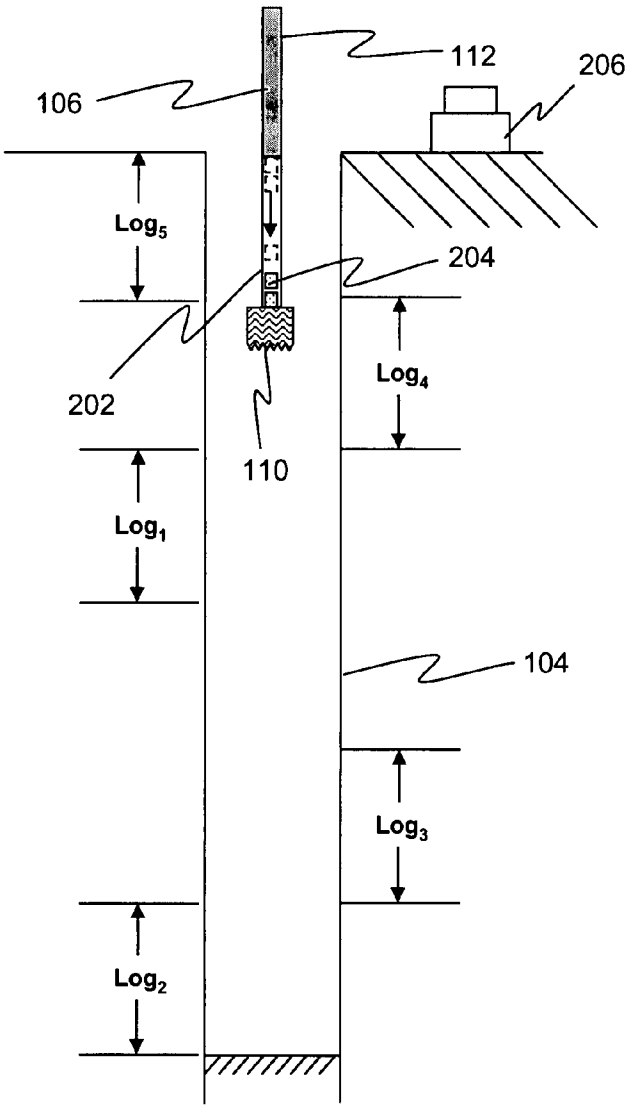
FIG. 15 is a side view of the logging device of FIG. 3 associated with a drill string disposed within a borehole.
Figure 16:
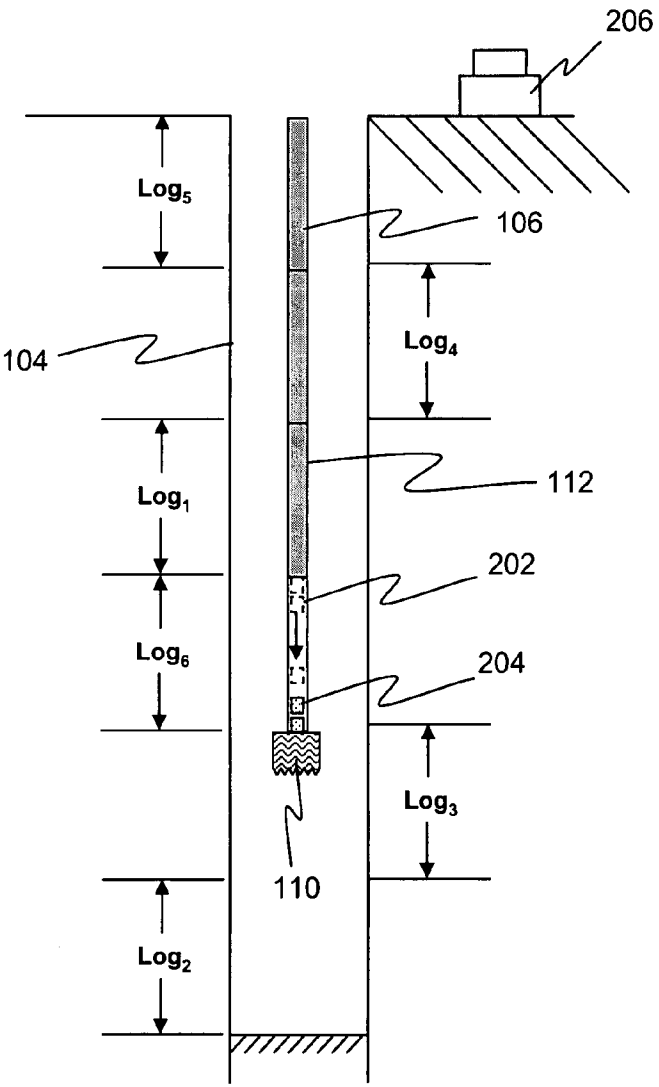
FIG. 16 is a side view of the logging device of FIG. 3 associated with a drill string disposed within a borehole.

Optionally, after the drill bit portion 110 has been changed, the drilling subassembly 106 must be reassembled and inserted back into the borehole 104. Using the same approach as was used during the removal of the drill bit portion 110, the drilling subassembly 106 is re-inserted into the borehole 104 until the drill portion 110 is positioned just below the borehole area last measured and identified as $Log_4$, as shown in FIG. 15. A fifth scan may be conducted, wherein the sensor data is identified as $Log_5$ and stored in the data storage device 216. More drill pipes 112 may be added to the drilling subassembly 106 and the drilling subassembly 106 is inserted deeper into the borehole 104 until the drill bit portion 110 is positioned just below the borehole area where the second to last measurement, identified as $Log_3$, took place, as shown in FIG. 16. A sixth scan may be conducted, wherein the sensor data is identified as $Log_6$ and stored in the data storage device 216. Again, this process may be repeated as many times as desired and/or as necessary to obtain a complete measurement of the borehole 104. Once the scan has been completed, the drilling subassembly 106 may be completely reinserted into the borehole 104 and the drilling process may be restarted. The above process may be repeated until the desired depth of the borehole 104 is achieved. It should be appreciated that all of the sensor data $Log_1$, $Log_2$, $Log_3$, $Log_4$, $Log_5$, $Log_6$ up to $Log_n$ may then be combined to achieve a highly accurate characteristic map, including depth measurement and ROP, of the borehole 104.

Figure 17:
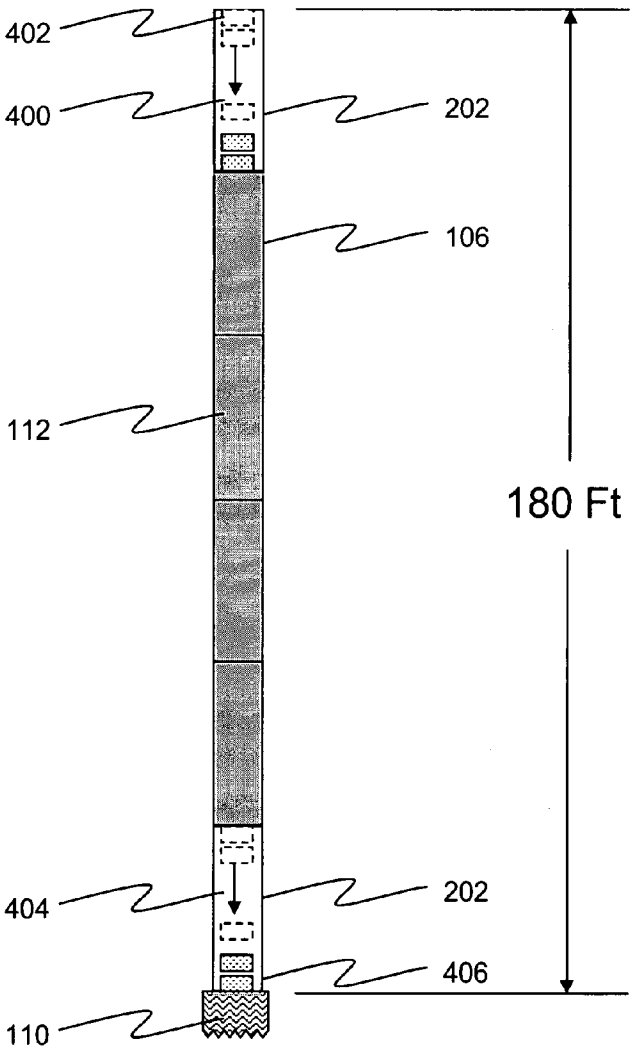
FIG. 17 is a side view of a drill string associated with multiple logging devices of FIG. 3.

Additionally, it is contemplated that several logging devices 202 may be disposed within the drilling subassembly 106 to expedite the well logging process. For example, referring to FIG. 17, consider the situation where the drilling subassembly 106 employs two (2) logging devices 202, wherein the logging devices 202 are disposed in a one hundred and eighty foot (180 ft) section of the drilling subassembly 106 which is comprised of four (4) substantially equivalent drill pipes 112 and two (2) logging devices 202, each of which are thirty feet (30 ft) long. In this example, a first logging device 400 is disposed on a first end 402 of the indicated section of drilling subassembly 106 and a second logging device 404 is disposed on a second end 406 of the indicated section of drilling subassembly 106. Furthermore, the approach described hereinabove for using a single logging device 202 to generate a complete (or almost complete) survey of the borehole 104 may also be used for drill strings having multiple logging devices 202.

Figure 18:
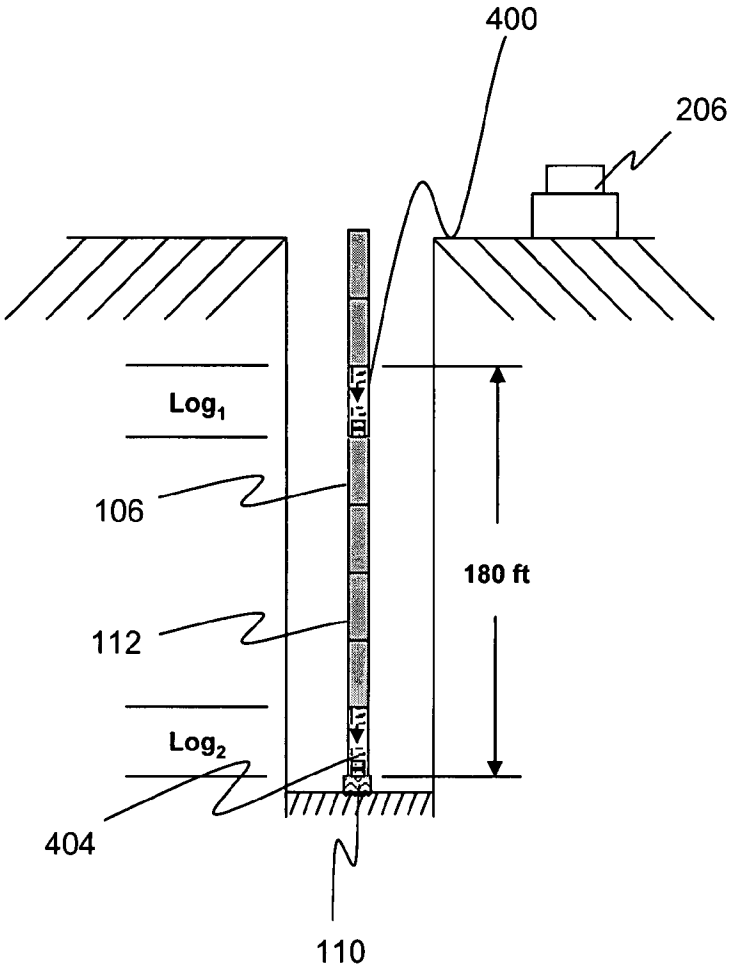
FIG. 18 is a side view of a drill string using multiple logging devices of FIG. 3 disposed within a borehole.
Figure 19:
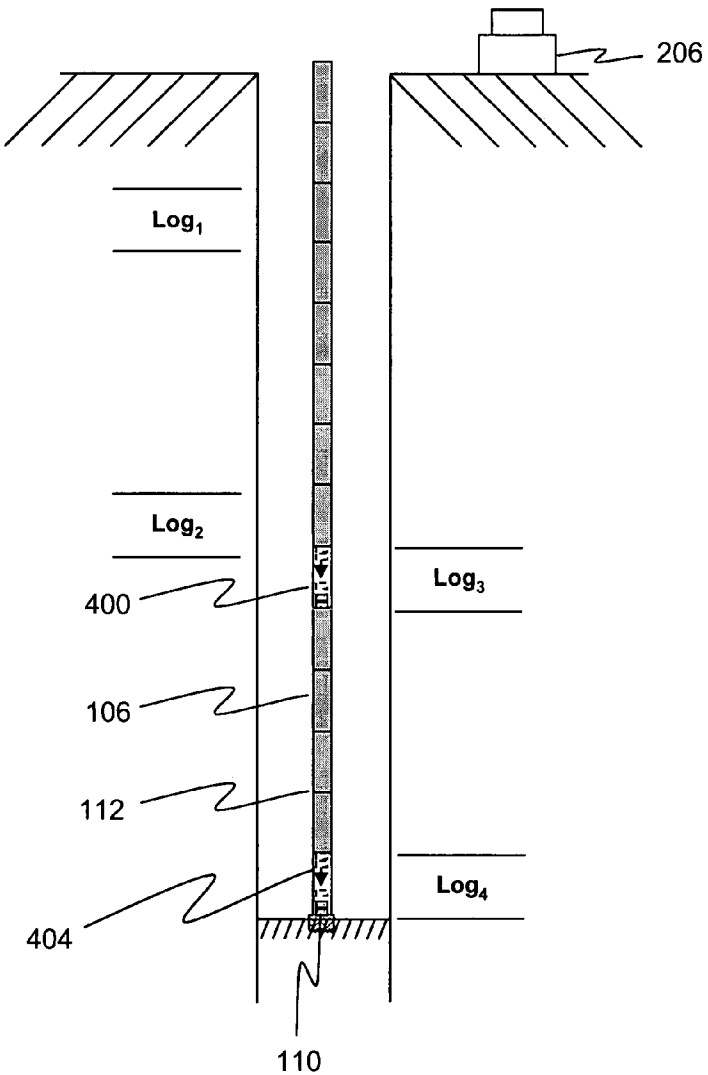
FIG. 19 is a side view of a drill string using multiple logging devices of FIG. 3 disposed within a borehole.

Referring to FIG. 18, when the borehole 104 is deep enough such that drill pipes 112 have to be added to the drilling subassembly 106, the drilling is stopped and the drill pipes 112 are added. During this delay borehole measurements are conducted and sensor data for multiple borehole portions are generated, identified as $Log_1$ and $Log_2$ and stored within the data storage device 216. Referring to FIG. 19, the drilling resumes until more drill pipes 112 have to be added to the drilling subassembly 106. Again, the drilling is stopped and more drill pipes 112 are added to the drilling subassembly 106. During this delay more borehole measurements are conducted and sensor data for additional borehole portions are generated, identified as $Log_3$ and $Log_4$ and stored within the data storage device 216. It should also be appreciated that the lengths used herein are provided as an example only and are not intended to be limiting.

Figure 20:
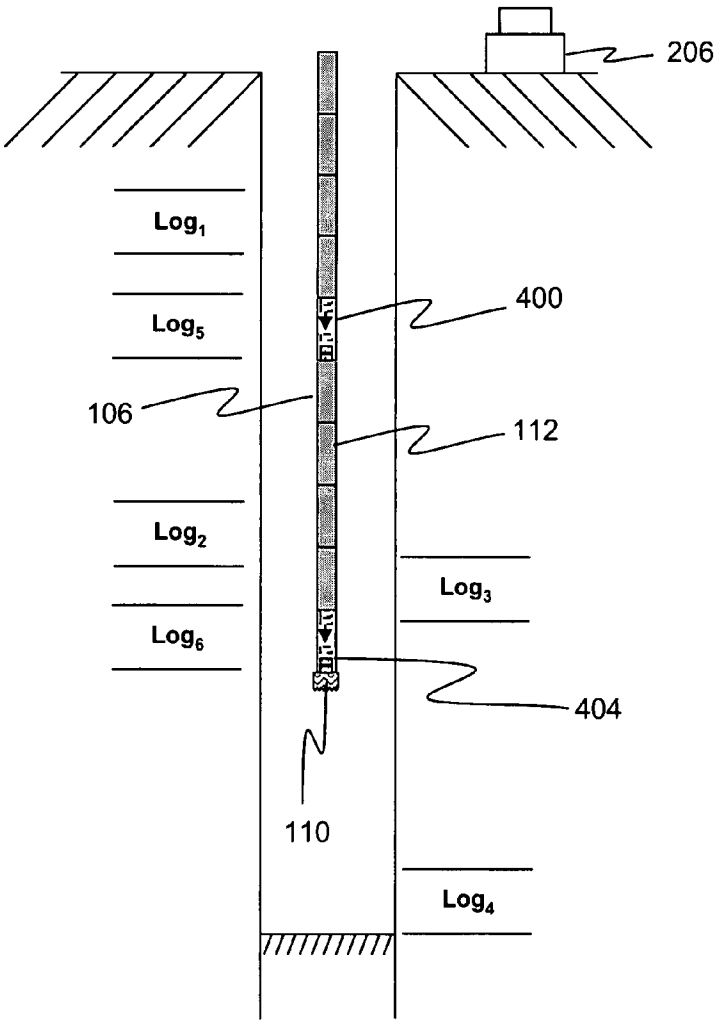
FIG. 20 is a side view of a drill string using multiple logging devices of FIG. 3 disposed within a borehole.
Figure 21:
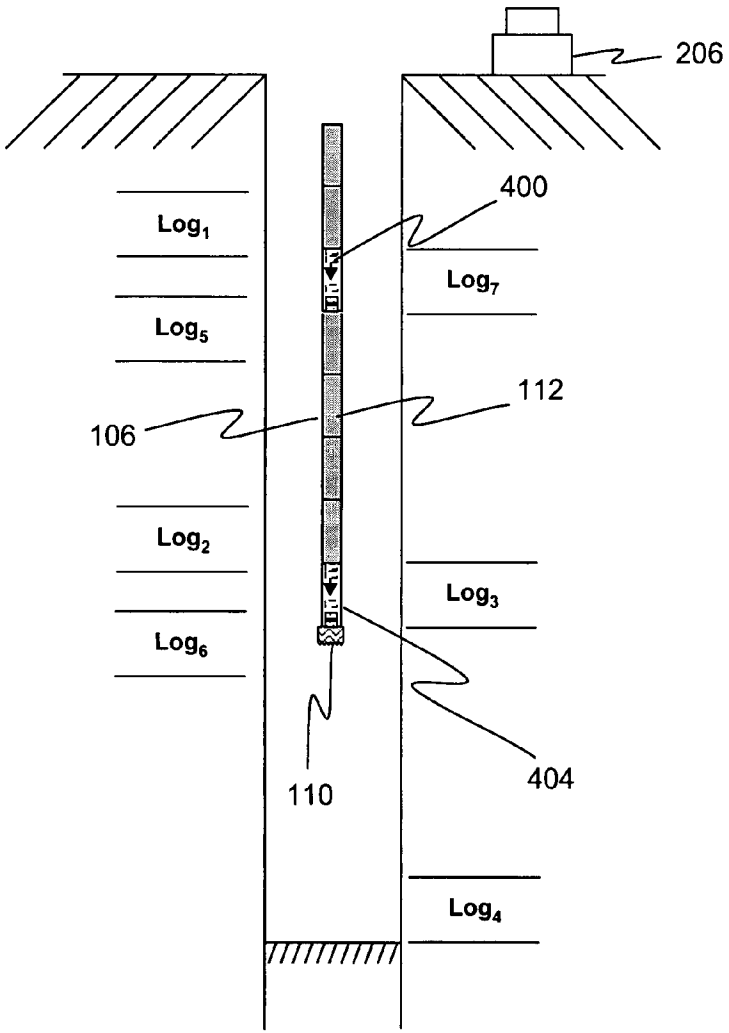
FIG. 21 is a side view of a drill string using multiple logging devices of FIG. 3 disposed within a borehole.
Figure 22:
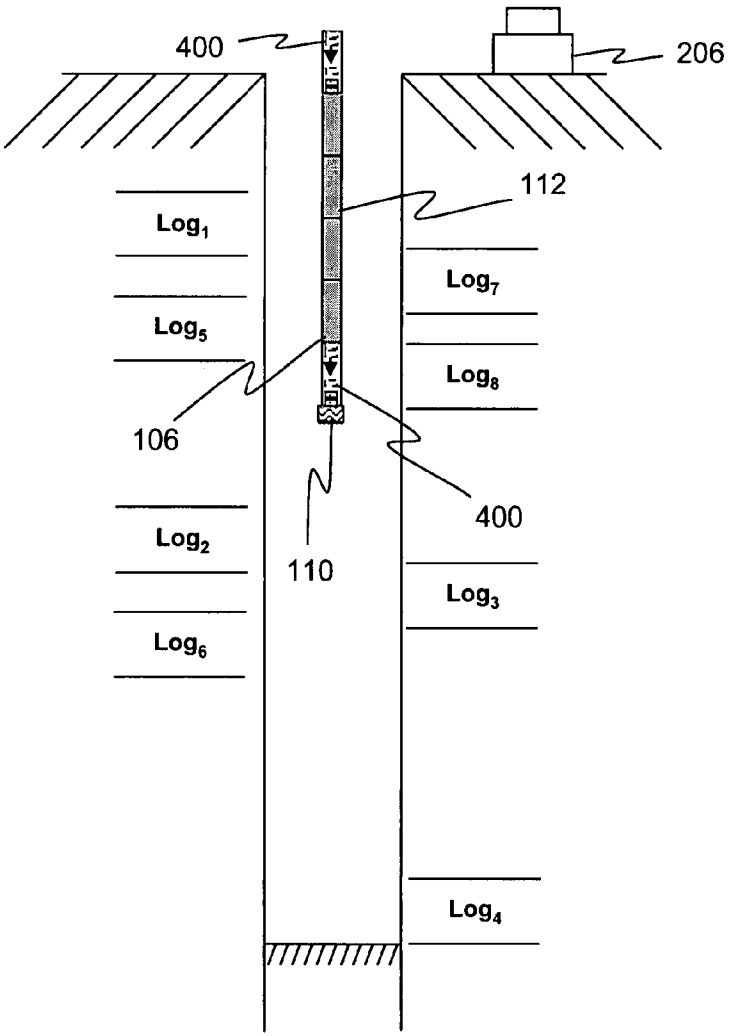
FIG. 22 is a side view of a drill string using multiple logging devices of FIG. 3 disposed within a borehole.
Figure 23:
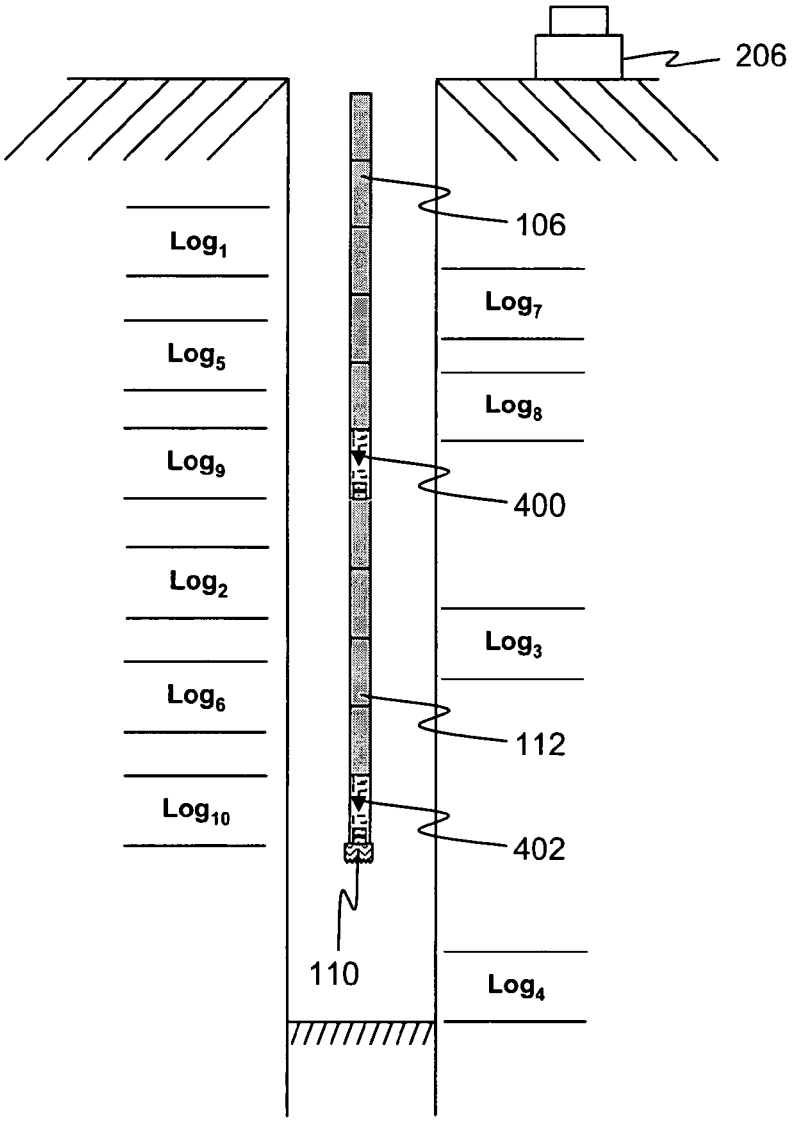
FIG. 23 is a side view of a drill string using multiple logging devices of FIG. 3 disposed within a borehole.
Figure 24:
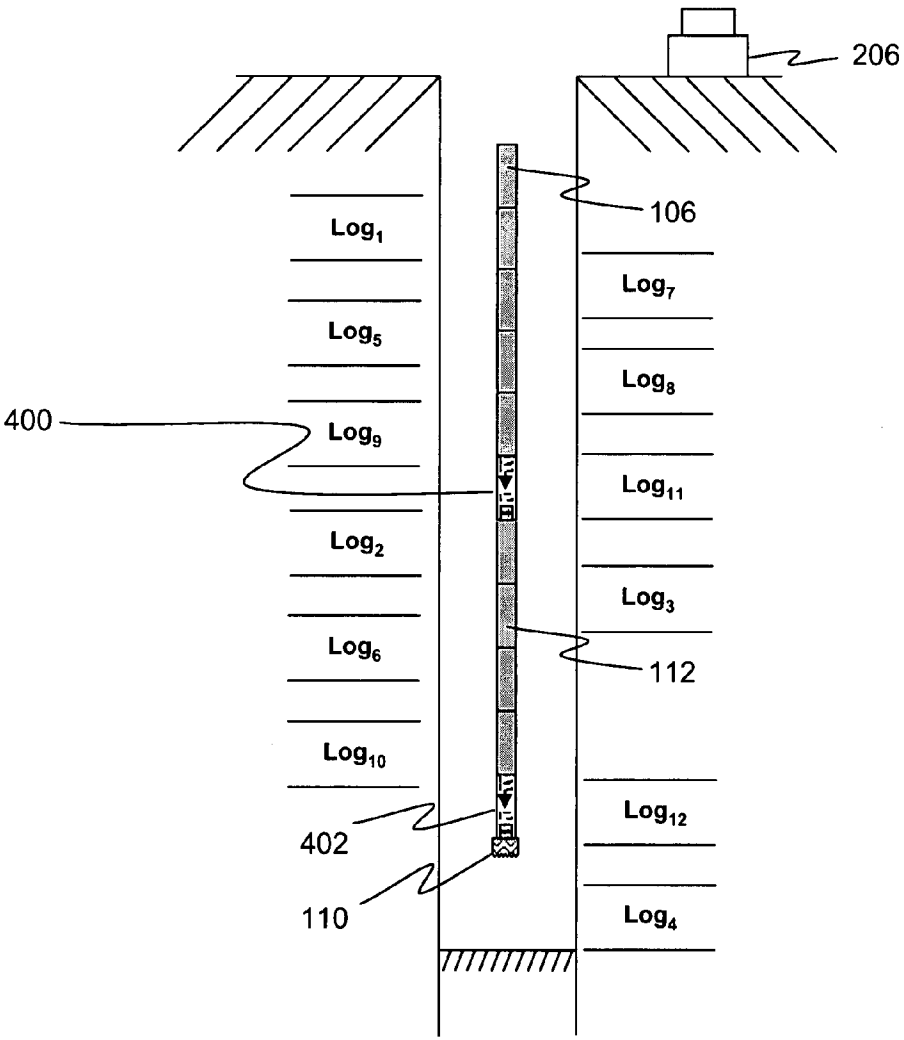
FIG. 24 is a side view of a drill string using multiple logging devices of FIG. 3 disposed within a borehole.
Figure 25:
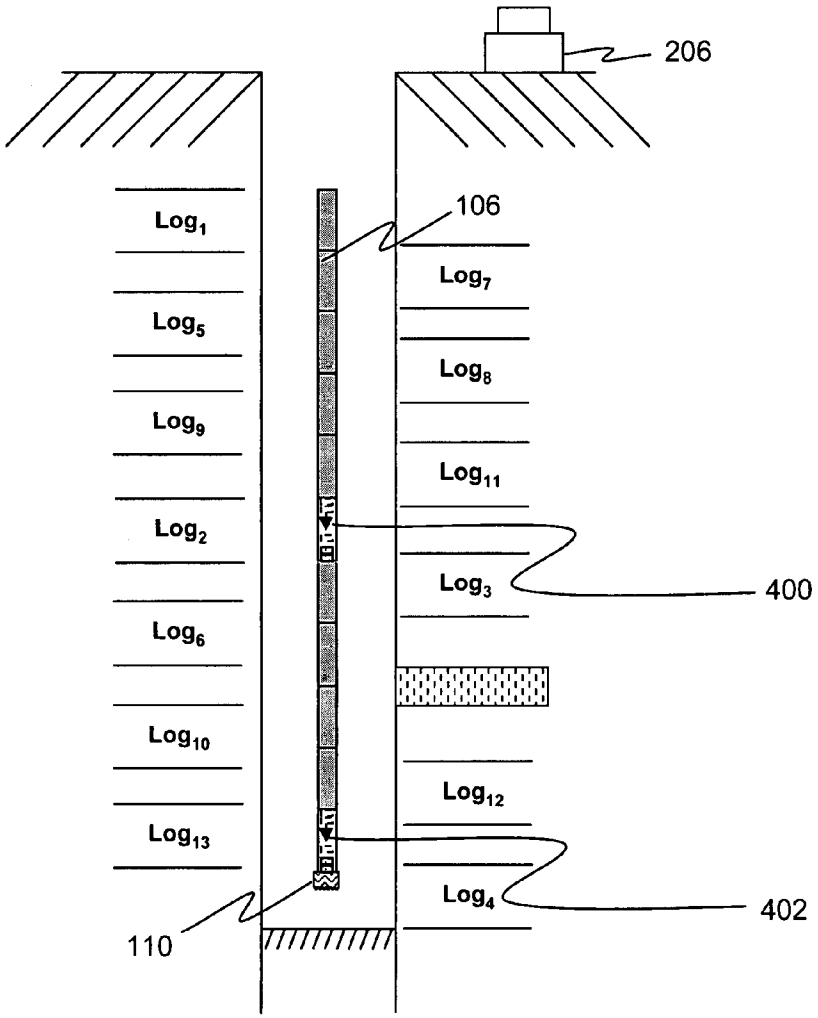
FIG. 25 is a side view of a drill string using multiple logging devices of FIG. 3 disposed within a borehole.

For purposes of this example, assume at this point that the drill bit portion 110 must be changed and the entire drilling subassembly 106 is removed from the borehole 104. The drilling subassembly 106 is raised from the borehole 104 until the first logging device 400 and the second logging device 404 are disposed in the borehole 104 to slightly overlap an area that has already been logged. Referring to FIG. 20, in this case the drilling subassembly 106 was stopped when the second logging device 404 was slightly overlapping the area of the borehole 104 that corresponds to the sensor data identified as $Log_3$. Measurements of the borehole 104 are conducted and sensor data for multiple borehole portions are generated, identified as $Log_5$ and $Log_6$ and stored within the data storage device 216. As shown in FIG. 21 and FIG. 22, this process is repeated until the entire drilling subassembly 106 is removed from the borehole 104, as indicated by $Log_7$ and $Log_8$. After the drill bit portion 110 has been replaced, more measurements are conducted during the reintroduction of the drilling subassembly 106 into the borehole 104, as shown in FIG. 23, FIG. 24 and FIG. 25 and as indicated by $Log_9$, $Log_{10}$, $Log_{11}$, $Log_{12}$ and $Log_{13}$. The sensor data $Log_1$, $Log_2$, $Log_3$, $Log_4$, $Log_5$, $Log_6$ up to $Log_{13}$ may then be combined to achieve a highly accurate characteristic map, including depth measurement of the borehole 104.

It should be appreciated that for every new section of drilling pipe 112 added to the drilling subassembly 106, there may be an overlap section which may be used to correlate the logs produced during the scan. This correlation may then be used to determine information regarding the length of the actual drill penetration for every new addition of drill pipe 112. Moreover, determination of the well trajectory length may be performed with the logs produced. Additionally, the sensor data at $Log_1$ should correlate with the sensor data at $Log_2$ and as such, any shift between $Log_1$ and $Log_2$ may be indicative of a deviation of the actual penetration from the surface depth measurement possibly indicating a mismatch between the head and tail of the drilling subassembly 106 due to various reasons, such as sticking or buckling of the drilling subassembly 106.

Figure 26:
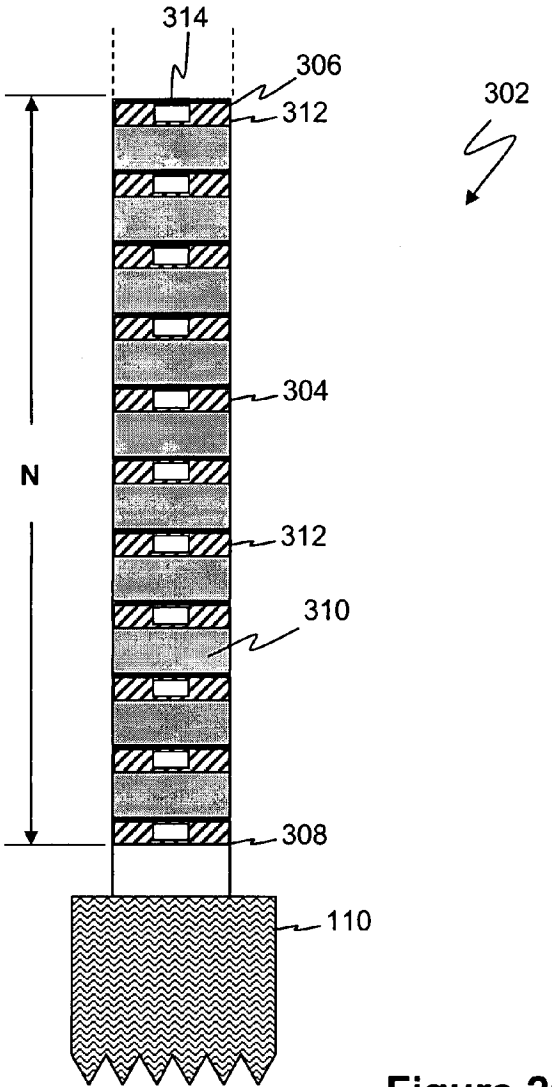
FIG. 26 is a cross sectional side view of a logging device in accordance with a second embodiment.

Referring to FIG. 26, a second embodiment of a logging device 302 is shown and includes a logging device structure 304, wherein the logging device structure 304 includes a first logging device structure end 306, a second logging device structure end 308 and a logging device structure length N. Additionally, the logging device structure 304 defines a logging device structure cavity 310 extending the logging device structure length N to communicate the first logging device structure end 306 with the second logging device structure end 308. The logging device 302 may also include a plurality of sensing devices 312 each of which may include a data storage device 314, wherein the plurality of sensing devices 312 may be disposed within the logging device structure cavity 310 and distributed along the length N of the logging device 302 and/or the plurality of sensing devices 312 may be disposed external to the logging device structure 304 and distributed along the length N of the logging device 302. Furthermore, distributing the sensing devices 312 along the logging device 302 may negate the necessity for a moving sensing device 312. Additionally, having an array of sensing devices 312 would allow for the generation of data while the logging device 302 is moving because the data may be generated in a quick, 'snapshot' fashion.

Figure 27:
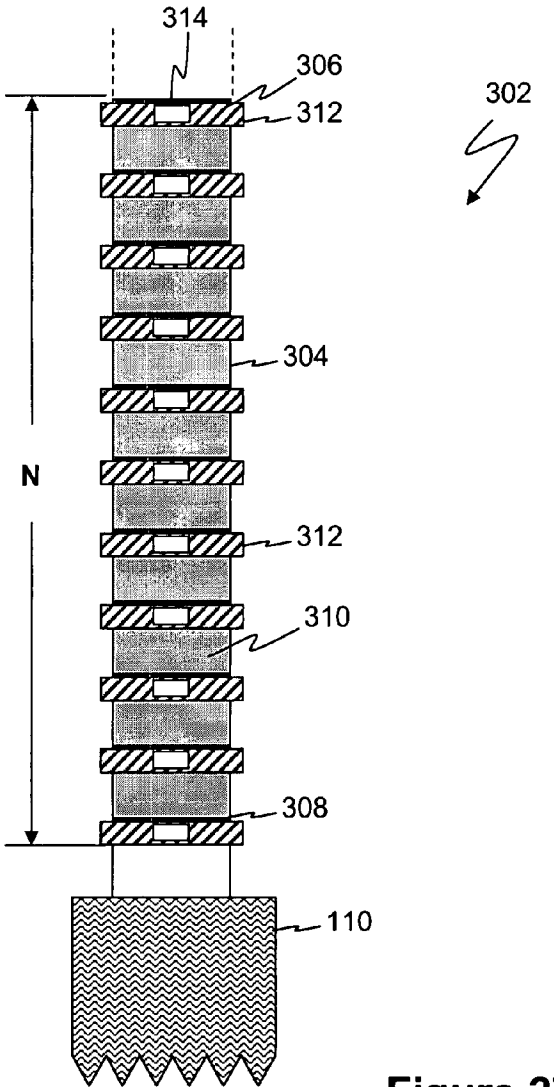
FIG. 27 is a cross sectional side view of a logging device in accordance with a second embodiment.

It should be appreciated that although a logging device having a sensing device that traverses a portion of the logging device should be stationary to obtain measurements, a logging device 302 having an array of sensing devices 312, as shown in FIG. 26 and FIG. 27, may obtain measurements when the drilling subassembly 106 is moving or is stationary. As discussed hereinabove, as the drilling subassembly 106 is stationary, the sensing devices 304 may create Logs by scanning the geophysical properties of the adjacent strata. This scanning may be accomplished by activating all of the sensing devices 312 simultaneously to scan the entire length N of the logging device structure 304 or by activating the individual sensing devices 312 in a progressive and/or timed manner, such as activating the sensing device 312 closest to the drill bit portion 110 first and scanning up the entire length N of the logging device structure 304, terminating the scan with the sensing device 312 farthest from the drill bit portion 110. The data obtained during the scan may then be saved in the data storage device 314 for later processing and may be correlated to account for any stretching in the drilling subassembly 106. Additionally, as with the first embodiment 100, the sensing device 312 may also be disposed external to the logging device structure 304, as shown in FIG. 27.

Each of the individual sensor data logs (i.e. $Log_1$, $Log_2$, $Log_3$, $Log_4$, $Log_5$, $Log_6$ to $Log_n$) may include the length of the borehole portion measured during the scan, a Time Stamp $TS_1$ indicating the start of a scan, a Time Stamp $TS_2$ indicating the end of a scan as well as any other type of data suitable to the desired end purpose, such a porosity, bulk density and resistivity. The time stamp values ($TS_1$ and $TS_2$) for each of the sensor data logs may then be used to correlate the logs following the scan. As such the Rate of Penetration (ROP) may also be determined. It is contemplated that the borehole data, including the Time Stamp TS data, may be communicated to a surface processor for further processing or may be processed downhole via a processor associated with the logging device 202, 302.

Figure 28:
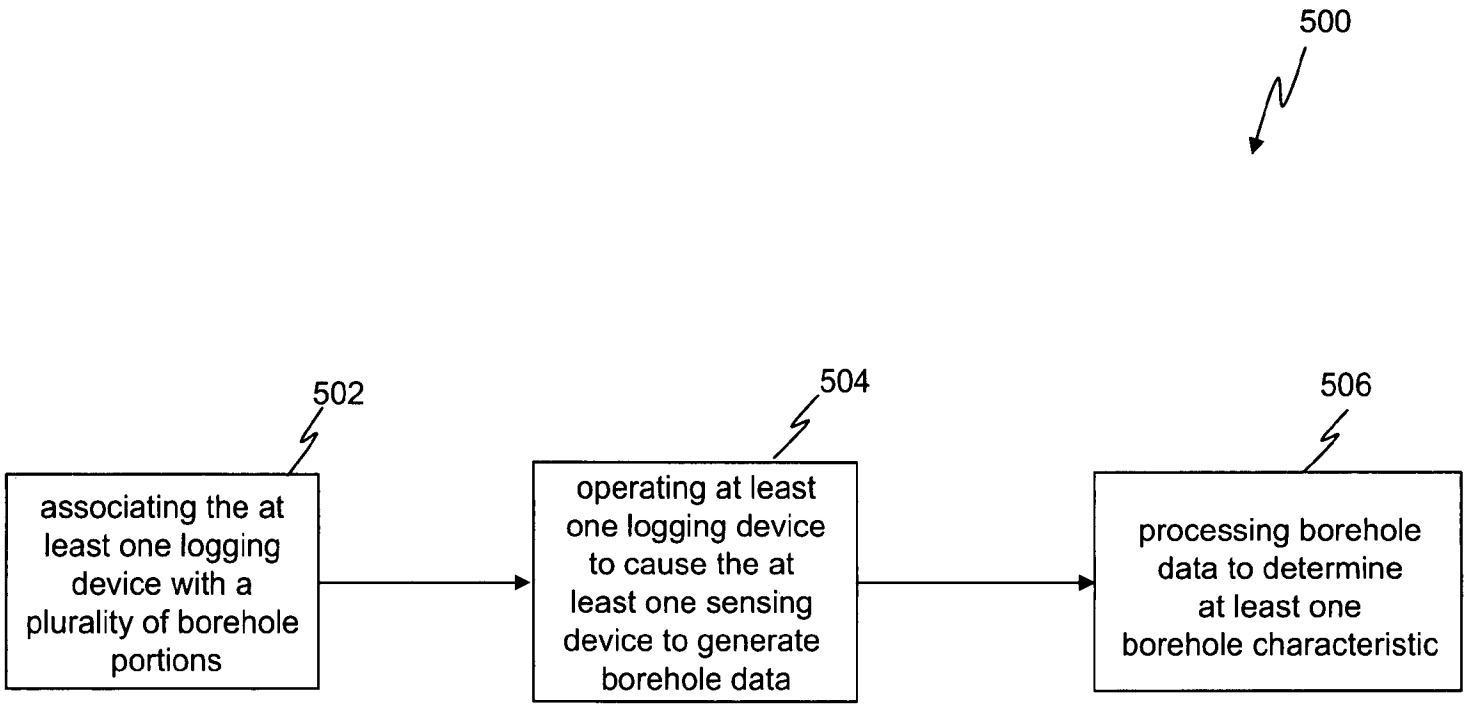
FIG. 28 is a block diagram illustrating a method for determining the characteristics of a borehole using the logging device of FIG. 3.

Referring to FIG. 28, a block diagram describing a method 500 for determining a geophysical characteristic of a borehole using at least one logging device 202, 302 is illustrated, wherein the at least one logging device 202, 302 includes at least one sensing device 204, 312. The method 500 includes associating the at least one logging device 202, 302 with a plurality of borehole portions, as shown in operational block 502, wherein each of the plurality of borehole portions includes a borehole portion length which may be approximately the length of the logging device 203, 302. The method 500 further includes operating the logging device 202, 302 to cause the sensing device 204, 312 to generate borehole data for at least a portion of the borehole portion length for each of the plurality of borehole portions, as shown in operational block 504. Additionally, the method 500 includes processing the borehole data to determine at least one borehole characteristic, as shown in operational block 506, wherein the processing may include correlating overlapping $Log_n$'s to develop continuous borehole data.

It is contemplated that the borehole data obtained as discussed hereinabove may also be used with a steerable drilling system for directing the logging device to a desired location, such as into a thin oil rim accumulation or reservoir, or to keep the logging device within a desire location. Referring to FIG. 28, a block diagram describing a method 500 for drilling a borehole using a drilling system 502 having a steerable drill string is illustrated, wherein the drilling system 502 includes at least one logging device 202, 302 having at least one sensing device 204, 312. The method 500 includes associating the at least one logging device 202, 302 with a plurality of borehole portions, as shown in operational block 502, wherein each of the plurality of borehole portions includes a borehole portion length which may be approximately the length of the logging device 203, 302. The method 600 further includes operating the logging device 202, 302 to cause the sensing device 204, 312 to generate borehole data for at least a portion of the borehole portion length for each of the plurality of borehole portions, as shown in operational block 504. The borehole data for each of the borehole portions may include borehole characteristics such as length of the borehole portion, angle of the borehole portion, porosity, resistivity and bulk density of the borehole material. The borehole data may then be processed to map the depth and/or direction of the borehole, as shown in operational block 506, wherein the steerable drilling system 602 may be operated to cause the logging device 202, 302 to drill a borehole to a desired location.

The logging device and method described herein allows for the generation of borehole data while conserving power and increasing the duty cycle. This is because traditional ways to obtain borehole data involves continuously scanning the borehole during the drilling process with traditional logging devices. Thus, the traditional logging device is continuously being operated and a large amount of data is obtained for very small changes in borehole depth. As such, a large portion of the data obtained by traditional logging devices and methods is extraneous data that must be filtered out. However, the logging device and method described herein allows for borehole data to be obtained during predefined intervals, wherein the logging device is not being operated between the predefined intervals in order to conserve power. Additionally, because the data is generated only at predefined intervals, the data obtained is responsive to finalized changes in borehole depth and is thus less voluminous and more accurately portrays borehole characteristics.

As described above, the method 500 of FIG. 28, in whole or in part, may be applicable to any type of drilling method suitable to the desired end purpose such as the Logging While Drilling method and the wireline Method and may be embodied in the form of computer-implemented processes and apparatuses for practicing those processes. The method 500 of FIG. 29, in whole or in part, may also be embodied in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. Existing systems having reprogrammable storage (e.g., flash memory) may be updated to implement the method 500 of FIG. 28, in whole or in part.

Also as described above, the method 500 of FIG. 28, in whole or in part, may be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments may configure the microprocessor to create specific logic circuits.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A method for determining the length of a borehole, the method comprising:

associating at least one logging device with the borehole, wherein said at least one logging device includes at least one sensing device, wherein said at least one logging device includes a logging device structure length;

operating said at least one sensing device to generate borehole data responsive to a borehole portion disposed essentially adjacent said at least one logging device structure length, wherein said borehole data includes start time of scan, location of said at least one sensing device at start time of scan, stop time of scan and location of said at least one sensing device at stop time of scan; and generating borehole characteristic data by correlating at least a portion of said borehole data to determine the length of at least a portion of the borehole.

2. The method of claim 1, wherein said associating includes associating said at least one sensing device with a drill string and positioning said at least one sensing device within the borehole via said drill string, wherein said drill string is actuated via a drill rig.

3. The method of claim 2, wherein said drill string is controllably steerable and wherein said operating said at least one sensing device includes directing said controllably steerable drill string responsive to said correlating at least a portion of said borehole data.

4. The method of claim 1, wherein said borehole data includes data responsive to at least one of porosity, resistivity and bulk density.

5. The method of claim 1, wherein said operating includes generating said borehole data for a plurality of said borehole portions.

6. The method of clam 5, wherein said generating includes processing said borehole data for each of said plurality of said borehole portions to generate cumulative borehole data, such that said borehole data for each of said plurality of said borehole portions overlaps said borehole data for adjacent borehole portions.

7. The method of claim 1, wherein said generating further includes processing said borehole data to determine the Rate of Penetration.

8. A method for determining a geophysical characteristic of a borehole using at least one logging device, wherein the at least one logging device includes at least one sensing device, the method comprising:

associating the at least one logging device with the borehole, wherein the at least one logging device includes a logging device structure length;

operating the at least one sensing device to generate borehole data responsive to a borehole portion disposed essentially adjacent said logging device structure length, wherein said borehole data includes start time of scan, location of said at least one sensing device at start time of scan, stop time of scan and location of said at least one sensing device at stop time of scan;

correlating said borehole data to determine the geophysical characteristic; and generating borehole characteristic data responsive to the geophysical characteristic.

9. The method of claim 8, wherein said associating includes associating the at least one logging device with a drill string and positioning the at least one logging device within the borehole via said drill string, wherein said drill string is actuated via a drill rig.

10. The method of claim 9, wherein said associating includes associating the at least one logging device with a controllably steerable drill string and wherein said operating includes directing said controllably steerable drill string responsive to said correlating said borehole data.

11. The method of claim 8, wherein said borehole data includes data responsive to at least one of porosity, resistivity and bulk density.

12. The method of claim 8, wherein said operating includes generating said borehole data for a plurality of said borehole portions.

13. The method of claim 8, wherein said correlating includes processing said borehole data for a plurality of said borehole portions to generate said borehole data responsive to a predetermined portion of the borehole.

14. The method of claim 8, wherein said correlating includes processing said borehole data such that each of said borehole data for said plurality of said borehole portions overlaps said borehole data for adjacent borehole portions.

15. The method of claim 8, wherein the geophysical characteristic is the borehole length.

16. The method of claim 8, wherein the geophysical characteristic is the Rate of Penetration.

17. A logging device for use with a drill rig having a drill string that is associated with a borehole, the logging device comprising:

a device housing, wherein said device housing is configured to be associated with the drill string and wherein the device housing includes a housing length; and at least one sensing device, wherein said at least one sensing device is associated with said device housing to generate sensor data responsive to a characteristic of at least a portion of the borehole, wherein said portion of the borehole corresponds to at least a portion of said housing length.

18. The logging device of claim 17, wherein the logging device further includes a processing device for processing said sensor data to determine a borehole characteristic, wherein said borehole characteristic includes at least one of a borehole depth and a Rate of Penetration.

19. The logging device of claim 18, wherein said device housing is configured to be associated with drill pipes contained within the drill string, wherein the drill string is controllably steerable in a manner responsive to said borehole characteristic.

20. The logging device of claim 18, wherein the logging device includes a data storage device, wherein said data storage device is associated with at least one of said at least one sensing device and said processing device.

21. The logging device of claim 17, wherein said at least one sensing device is associated with said device housing such that said at least one sensing device traverses said device housing length.

22. The logging device of claim 17, wherein said at least one sensing device includes a plurality of sensing devices associated with said device housing to be distributed along said device housing length.

* * * * *